US006959587B2

(12) United States Patent
Schulz et al.

(10) Patent No.: US 6,959,587 B2
(45) Date of Patent: Nov. 1, 2005

(54) HEATABLE TANK LEAKAGE DIAGNOSIS UNIT, PARTICULARLY FOR MOTOR VEHICLES

(75) Inventors: Wolfgang Schulz, Bietigheim-Bissingen (DE); Martin Maier, Moeglingen (DE); Manfred Zimmermann, Bad Rappenau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/474,122

(22) PCT Filed: Mar. 27, 2002

(86) PCT No.: PCT/DE02/01108

§ 371 (c)(1),
(2), (4) Date: Feb. 10, 2004

(87) PCT Pub. No.: WO02/081898

PCT Pub. Date: Oct. 17, 2002

(65) Prior Publication Data

US 2004/0129066 A1 Jul. 8, 2004

(30) Foreign Application Priority Data

Apr. 4, 2001 (DE) ..... 101 16 693

(51) Int. Cl.[7] ..... G01M 19/00
(52) U.S. Cl. ..... 73/49.7; 73/40; 73/118.1
(58) Field of Search ..... 73/40, 49.7, 118.1; 123/520

(56) References Cited

U.S. PATENT DOCUMENTS

| | | | | |
|---|---|---|---|---|
| 2,647,215 A | | 7/1953 | Egglestone | 310/72 |
| 3,445,743 A | | 5/1969 | Blair | |
| 5,088,466 A | | 2/1992 | Tada | |
| 5,635,806 A | * | 6/1997 | Wissmach et al. | 318/245 |
| 5,786,529 A | * | 7/1998 | Voss et al. | 73/40.7 |
| 5,890,474 A | * | 4/1999 | Schnaibel et al. | 123/520 |
| 5,974,861 A | | 11/1999 | Cook et al. | |
| 6,112,728 A | | 9/2000 | Schwegler et al. | 123/520 |
| 6,234,152 B1 | | 5/2001 | Fritz et al. | 123/520 |
| 6,550,315 B2 | * | 4/2003 | Streib | 73/49.7 |
| 6,615,808 B2 | * | 9/2003 | Streib | 123/520 |

FOREIGN PATENT DOCUMENTS

| | | | | |
|---|---|---|---|---|
| DE | 196 36 431 | | 3/1998 | 123/520 |
| DE | 100 18 441 | | 4/2000 | 73/49.7 |
| DE | 100 06 186 | | 6/2001 | 123/520 |
| EP | 0 563 724 | | 10/1993 | |
| EP | 0 579 541 | | 1/1994 | |
| GB | 2339291 | | 1/2000 | |
| JP | 56-97713 | * | 8/1981 | |

* cited by examiner

*Primary Examiner*—Daniel S. Larkin
(74) *Attorney, Agent, or Firm*—Walter Ottesen

(57) ABSTRACT

In a method and an arrangement for checking the tightness of a vessel (10), especially of a tank-venting system of a motor vehicle, the vessel (10) is charged with a pressure generated by a motor-driven pressure source (30) and the motor current is determined. A reference leak (36) is selectively driven by a switchover valve (32) and is charged with a corresponding pressure and the motor current is determined. The determined electrical characteristic quantity and the determined reference characteristic quantity are compared and a conclusion is drawn therefrom as to the presence of a leak. To prevent the entry of moisture into the pressure source (30), it is provided that at least the pressure source (30) is heated intermittently. The heating takes place preferably by driving the switchover valve (32) at a suitable pulse duty factor. To prevent the entrance of moisture into the pressure source (30), a check valve (44) is provided and is suitably mounted in the connecting part of the pressure source (30).

3 Claims, 1 Drawing Sheet

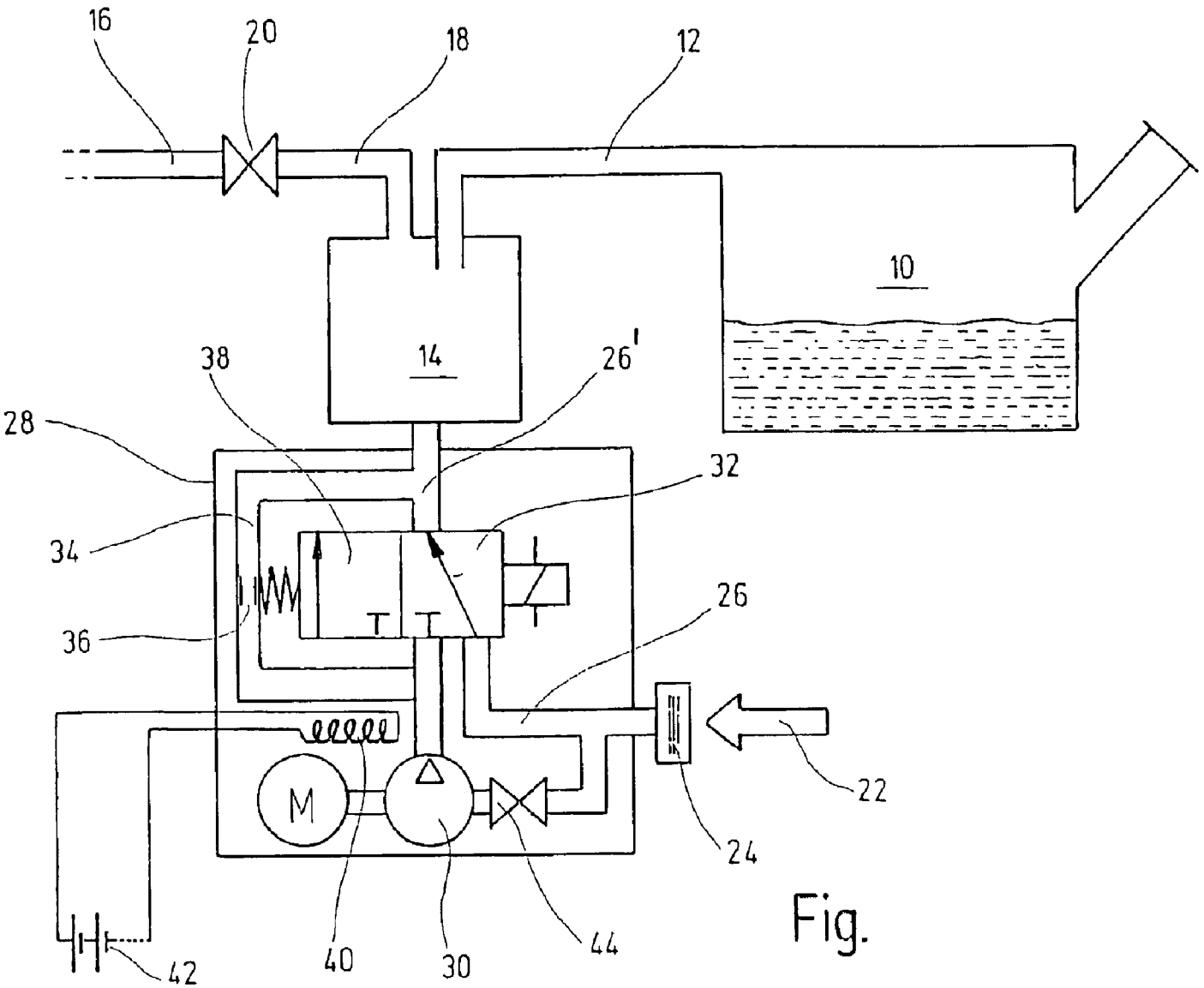
Fig.

HEATABLE TANK LEAKAGE DIAGNOSIS UNIT, PARTICULARLY FOR MOTOR VEHICLES

This application is the United States national phase of international application PCT/DE02/01108, filed Mar. 27, 2002, designating the United States.

1. Field of the Invention

The invention relates to a method and an arrangement for checking the operability of a vessel, especially of a tank-venting system of a motor vehicle.

2. Background of the Invention

In the most different areas of technology, vessels have to be checked regularly as to their tightness. Accordingly, in the chemical processing industry, for example, liquid or gas vessels are correspondingly checked or, in the motor vehicle area, tank systems are checked.

In the manufacture of motor vehicles, in the future, tighter statutory regulations, for example, in the United States, will apply for the operation of internal combustion engines. Accordingly, it will be necessary that motor vehicles, for which volatile fuels such as gasoline are used, include a control device which can detect an existing leak of the size of 0.5 mm in the tank or in the entire fuel tank system utilizing on-board means.

For example, U.S. Pat. No. 5,890,474 discloses such a method for checking the tightness of a tank-venting system of a motor vehicle. Here, the tank-venting system is charged with an overpressure and, with a subsequent evaluation of the course of the pressure, a conclusion is drawn as to the presence of a leak as may be required.

From U.S. Pat. No. 5,890,474, it is also known to generate a back pressure between an electrically operated vane-type pump and a reference leak having a cross-sectional size of 0.5 mm. This back pressure lowers the pump rpm and simultaneously increases the electric current drawn by the vane-type pump. The value of the steady-state electric current which settles in is detected and is intermediately stored and, thereafter, the moved air flow of the pump is pumped via a switchover valve bypassing the reference leak and into the tank. If the tank is tight, then a higher pressure builds up as when pumping against the reference leak. The electrical current drawn by the pump is therefore higher than in the case of the reference leak. In contrast, for a leak having an opening cross section greater than 0.5 mm, the pressure, which settles in, lies below the reference pressure and the current drawn is therefore less.

Furthermore, U.S. Pat. No. 6,550,315 discloses to carry out the tightness check in accordance with the described reference measurement principle but by means of an under-pressure introduced into the tank-venting system.

SUMMARY OF THE INVENTION

The invention is based on the realization that especially during vehicle operation, humidity or even liquid, for example, a condensate, can become stored in the vane-type pump. For this reason, a considerable error occurs in the pump current determined in each case and erroneous detections of the degree of tightness result.

The present invention therefore has the task to improve a method or an arrangement, which are mentioned initially herein, so that the above-mentioned disadvantages of the state of the art, that is, the above-mentioned erroneous diagnoses based on a deposit or collection of moisture in the pressure source are avoided.

What is special about the invention is that at least the pressure source is heated at least from time to time. With the warming of the pressure source or of the total diagnostic unit, it is achieved that possibly present humidity is removed or it even is prevented that humidity, for example, in the form of condensate, can deposit on a cold pressure source.

According to a first embodiment, the above-mentioned warming takes place by means of an ohmic resistor, especially, a negative temperature coefficient (NTC) resistor. The resistor may exhibit a heating power between 1 and 10 watts, preferably the register exhibits a heating power in the region of 4 watts. With this power, suitable heat-up times result so that heating can preferably be carried Out only shortly before executing a diagnosis measurement and/or reference (leakage) measurement whereby a considerable amount of energy is saved. The use of an NTC resistor additionally affords the advantage that it can be additionally utilized in an energy saving manner because of the negative temperature coefficient at an already increased temperature because of the falling electrical resistance.

An alternative embodiment provides that the heating takes place via a suitable electric drive of the switchover valve. It can be provided either that the switchover valve is driven at a frequency or a pulse duty factor and the switchover valve is so driven that the switchover valve does not yet transfer into the operating state.

It can also be provided that the warming at least from time to time by means of an electric drive of the switchover valve takes place with an electric voltage below the operating voltage. The use of the switchover valve itself for warming affords the advantage that, in a cost saving manner, exclusively components can be used which are already present in a diagnostic unit. This is so because only an adaptation of the control of the switchover valve is required, for example, a simplified program adaptation. Compared to the first alternative, in total, additional costs for an additional component (NTC resistor) are saved for necessary electrical connections as well as for an additional output stage in a control apparatus.

Advantageously, the warming takes place during vehicle operation; however, this warming takes place in time outside of an executed diagnostic measurement or reference leak measurement. In addition, it can be provided that the warming begins with a pregiven time difference in advance of the start of a diagnostic measurement or reference measurement.

According to a further variation of the invention, that is an optional expansion of the above-mentioned alternatives, it can be provided that an occurrence of humidity and/or liquid into the pressure source takes place by means of a check valve mounted at the input of the pressure source. Advantageously, the check valve can be accommodated in the connecting part of the pressure source.

The invention relates further to a diagnostic unit which can be built into or be connected to a motor vehicle or other system having a vessel referred to above. The diagnostic unit preferably has the above-mentioned means for heating the pressure source or the overall diagnostic unit.

BRIEF DESCRIPTION OF THE DRAWING

The invention will now be described with reference to the drawing wherein:

The single FIGURE shows a tank-venting system wherein a method or an arrangement, which make use of the invention, is applied.

DESCRIPTION OF THE PREFERRED EMBODIMENTS OF THE INVENTION

The tank-venting system shown schematically in the Figure includes a tank 10 which is connected via a tank connecting line 12 to an active charcoal filter 14. An intake manifold 16 of an internal combustion engine (not shown) is connected to the tank 10 likewise via the active charcoal filter 14, an intake line 18 and a tank-venting valve 20.

Volatile hydrocarbon vapors form in the tank when filling the tank 10 or during operation of the engine (not shown). These hydrocarbon vapors reach the active charcoal filter 14 via the line 12 and are reversibly bound therein in a manner known per se.

Fresh air 22 is drawn by suction from the ambient through the active charcoal filter 14 when the tank-venting valve 20 is driven by a control unit (not shown) intermittently to open and close when the switchover valve 32 is correspondingly driven. Stored fuel is given up to the inducted air and the active charcoal filter 14 is regenerated thereby. Furthermore, a passive filter 24 is provided which connects the system, that is, a line 26, 26' connected upstream of the active charcoal filter 14 with ambient air from the ambient of the vehicle.

To diagnose the tightness of the tank-venting system, a leak diagnostic unit 28, which is connected to the active charcoal filter 14, is provided. It is noted that the position shown of the diagnostic unit 28 in the tank-venting system is only exemplary and the diagnostic unit can also be mounted at another location for another technical area of use, for example, directly on the tank.

The diagnostic unit 28 shown has a vane-cell pump 30 driven by a control unit (not shown). It is understood that the vane-cell pump 30 is only a preferred type of pump and, if required, can be exchanged with another type of pump, for example, a membrane pump or the like. A switchover valve 32 (for example, a 3/2 directional valve) is connected ahead of the pump 30. A reference leak 36 is introduced into a separate line branch 34 arranged parallel to the switchover valve 32. The reference leak 36 is opened or closed by means of a magnetic slide valve 38. The dimensioning of the reference leak 36 is so selected that it corresponds to the magnitude of the leak to be detected. In the case of the above-mentioned United States standard, the reference leak 36 has an opening cross section of approximately 0.5 mm.

The switchover valve 32 has two switching positions. In the first position and with the reference leak 36 closed, the pump 30 is connected pressure-conductingly to the tank 10 via the charcoal filter 14 and thereby pumps ambient air 22 into the tank 10. An overpressure of approximately 30 hPa is generated in the tank 10. During pumping of the fresh air 22 into the tank 10, that is, during one of the two diagnostic stages, the resulting electric pump current (diagnostic current) is continuously detected and intermediately stored for a later evaluation.

It is noted that, in the first position of the switchover valve 32, the already-described regeneration of the active charcoal filter 14 can be carried out in lieu of a tank diagnosis and with the tank-venting valve being open at the same time.

To carry out a reference measurement, that is, the second diagnostic stage, the switchover valve 32 is completely closed so that, when opening the reference leak 36 by means of the magnetic slide valve 38, the pump current (reference current) which results thereby is, in turn, detected and is likewise intermediately stored.

The diagnostic unit 28 also includes a computer module (not shown) for evaluating the time-dependent course of the values of the pump current detected in each case. The computer module can be a conventional microcontroller or processor. For this reason, no further discussion is provided. Usually, in the evaluation, that value is taken as the measured value whereat the time-dependent gradient of the pump current exceeds a pregivable value.

A conclusion can be drawn as to the presence of a leak in the tank 10 from the ratio of diagnostic current to reference current in a manner known per se.

In the housing of the diagnostic unit 28 shown, an NTC (negative temperature coefficient) resistor 40 is mounted having a heating power of approximately 4 watts. The NTC is driven by a voltage supply 42 and is used as a heater in the form of a heater spiral or the like in order to heat the entire diagnostic unit 28 and to remove possibly present humidity or to prevent deposits of moisture in the diagnostic unit 28 and/or the pump 30 already in advance.

It is noted that the use of the shown NTC 40 for heating the diagnostic unit 28 is shown only as an exemplary embodiment. In addition, it can be provided that only the pump 30 is locally heated to save energy.

According to a second embodiment, the heating takes place by means of the already available switchover valve 32 and via suitable driving procedures. In this case, the described NTC resistor 40 can be omitted.

In the embodiment shown, the switchover valve 32 is switched open and is without current during the normal operation of the vehicle, that is, when the diagnostic unit 28 is not operating or no diagnostic measurement takes place. Accordingly, the valve 32 is opened at least in the above-mentioned regeneration operation and when a reference leak measurement takes place.

According to a first variation of this embodiment, the procedure is that the switchover valve 32 is driven at a frequency or pulse duty factor so that a valve plate is not moved or moved only very slightly. The valve plate is not shown and is mounted in the switchover valve 32.

In a second variation, a voltage, which lies below the actual operating voltage of the valve 32, is so applied to the switchover valve 32 (that is, to a coil, not shown, mounted in the valve) so that the valve plate just does not move.

In both variations, as much electric loss energy as possible is to be used for heating the valve 32 but without the valve actually being driven, that is, without the valve plate being moved. Since, in both variations, the maximum possible loss power is not reached, a corresponding compensation takes place via the heating duration so that the warming has to take place correspondingly early in advance of the actual start of operation of the diagnostic unit 28.

According to a further variation of the invention or supplementary to the described variations or embodiments, the entry of moisture into the pump 30 is prevented or at least made more difficult in that, at the input of the pump 30, a check valve (RV) 44 is mounted. By means of the RV 44, the pump component 30 of the diagnostic unit 28 is protected against the entry of humidity. The RV 44 is so designed that it opens during operation of the pump 30 without large pressure losses.

It is finally noted and as mentioned initially herein, that, in the case of a diagnosis of the tank 10 or the tank-venting system, by means of an underpressure, the pressure direction of the pump 30 is correspondingly reversed but otherwise the operation is carried out correspondingly.

What is claimed is:

1. A method for checking the tightness of a vessel or a tank-venting system of a motor vehicle, the method comprising the steps of:

charging the vessel with an overpressure or underpressure generated by an electrically operated pressure source and determining an electric characteristic quantity of the pressure source (diagnostic measurement);

heating said pressure source at least intermittently;

charging a reference leak, which is operated selectively by a switchover valve, with a corresponding overpressure or underpressure generated by said pressure source and determining an electric reference characteristic quantity of said pressure source (reference measurement);

comparing the determined electric characteristic quantity and the determined reference characteristic quantity;

drawing a conclusion as to the presence of a non-tightness of the vessel from the results of the comparison; and wherein the at least intermittent heating takes place during vehicle operation, but, in time, outside of a diagnostic measurement or reference measurement which may take place.

2. The method of claim 1, wherein the heating takes place at a pregivable time difference in advance of a start of a diagnostic measurement or reference measurement.

3. A diagnostic unit for checking the tightness of a vessel or a tank-venting system of a motor vehicle, the diagnostic unit comprising means for warming the entire diagnostic unit as well as a control apparatus including means for carrying out the method steps of:

charging the vessel with an overpresaure or underpressure generated by an electrically operated pressure source and determining an electric characteristic quantity of the pressure source (diagnostic measurement);

heating said pressure source at least intermittently;

charging a reference leak, which is operated selectively by a switchover valve, with a corresponding overpresaure or underpressure generated by said pressure source and determining an electric reference characteristic quantity of said pressure source (reference measurement);

comparing the determined electric characteristic quantity and the determined reference characteristic quantity; and drawing a conclusion as to the presence of a non-tightness of the vessel from the results of the comparison.

* * * * *

UNITED STATES PATENT AND TRADEMARK OFFICE

CERTIFICATE OF CORRECTION

PATENT NO. : 6,959,587 B2
DATED : November 1, 2005
INVENTOR(S) : Wolfgang Schulz et al.

It is certified that error appears in the above-identified patent and that said Letters Patent is hereby corrected as shown below:

Column 6,
Lines 5 and 11, delete “overpresaure” and substitute -- overpressure --.

Signed and Sealed this

Twenty-eighth Day of February, 2006

JON W. DUDAS
*Director of the United States Patent and Trademark Office*